US006357796B1

(12) United States Patent
Halstead

(10) Patent No.: US 6,357,796 B1
(45) Date of Patent: Mar. 19, 2002

(54) SMOOTH BOOK CLIP

(76) Inventor: Florence Halstead, 1300 Lawrence St., El Cerrito, CA (US) 94530

( * ) Notice: Subject to any disclaimer, the term of this patent is extended or adjusted under 35 U.S.C. 154(b) by 0 days.

(21) Appl. No.: 09/641,210

(22) Filed: Aug. 18, 2000

Related U.S. Application Data

(60) Provisional application No. 60/150,418, filed on Aug. 24, 1999.

(51) Int. Cl.[7] ..... B42D 9/00
(52) U.S. Cl. ..... 281/42
(58) Field of Search ..... 281/42, 45, 28, 281/51, 15.1; 24/67.9, 546

(56) References Cited

U.S. PATENT DOCUMENTS

| | | | | | |
|---|---|---|---|---|---|
| 2,278,143 | A | * | 3/1942 | Matthews | 281/42 |
| 4,235,457 | A | * | 11/1980 | Brewer | 281/42 |
| 4,382,617 | A | * | 5/1983 | Fortier | 281/42 |
| 4,932,680 | A | * | 6/1990 | Rivera | 281/42 |
| D322,459 | S | * | 12/1991 | Pimienta | 281/42 X |

* cited by examiner

*Primary Examiner*—Willmon Fridie, Jr.

(57) ABSTRACT

A book clip formed of flexible elongated material such as wire that rebounds readily to its formed shape. The clip has two legs for slipping behind pages of a book on the right and left sides of the book. The legs are slightly further apart at the bottom for easy insertion between pages. A front cross-piece holds the pages of the book across the of the open pages so that the pages are pressed between the crosspiece and the right and left legs. The legs and crosspiece are joined by approximately parallel left and right arch pieces. The legs extend beyond the lower part of the crosspiece sufficiently so that they easily remain between the pages of the book when the book clip is slipped up for the pages to be turned. The book can then be stood up on its own, laid down, or propped against another object, thus leaving the hands free to write, eat or do other activities while a person has access to the open pages. The book clip is portable and can be easily inserted between pages of a closed book for marking the place when not in use. It takes very little space when being carried in a purse or pocket, either by itself or when marking the pages of a closed book.

4 Claims, 5 Drawing Sheets

SMOOTH BOOK CLIP

This Appln claims benefit of Prov. No. 60/150,418 filed Aug. 24, 1999.

BACKGROUND—FIELD OF INVENTION

This invention is a book clip smaller than a paperback book for holding the place in various-sized books and for keeping a book open and standing on its own without support.

BACKGROUND—DESCRIPTION OF PRIOR ART

Various book clips and holders have been invented in for hands-free reading or viewing. Many are book stands or holders designed for use only on a table or other stable surface. These are bulky and not easily transported. Additionally they are more costly than book clips.

Book clips and similar small holders are generally less bulky and more easily transported than other book holders. Some problems with previous designs include not properly holding the pages, obstructing vision of the print, being limited to holding only one type or size of book, or being too easily broken.

Several prior designs are made of plastic or similar material. Because of the rigidity of plastic, they would not adjust to fit a book as easily and would break more easily than would a clip made of wire. These designs generally obscure or blur the printing on the page. All but one (U.S. Pat. No. 5,152,553 listed below) are the widths of an opened book, so that they are still not as small as might be desired. Prior designs which have the limitations stated above include the following: U.S. Pat. No. 4,645,236 (Kemp), U.S. Pat. No. 4,767,094 (Brown), U.S. Pat. No. 5,152,553 (Domingo), U.S. Pat. No. 5,246,251 (Evans), U.S. Pat. No. 5,722,691 (Patel), U.S. Pat. No. 6,019,339 (Brayford) and U.S. Design Pat. No. 322,459 (Pirmienta).

Two other prior designs, U.S. Pat. No. 5,165,722 (Wong) and U.S. Pat. No. 5,165,723 (Evans), are made of wire or other similar material which is shaped such that the clips limit the width of books which can be held.

One prior design, U.S. Pat. No. 4,932,680 (Rivera), most closely approximates the smooth book clip. It is made of one piece of wire shaped to form a clip. It has two rear legs joined to the front crosspiece by an arch. In this prior design, where the arches join the top of the crosspiece, the right and left sections cross over in the front near the center of the book clip. This pushes one side of the wire back from the other, which pushes that whole side back toward the book. This gets in the way on that side when slipping the book clip over the open pages of the book. As the reader moves from page to page, a book clip is slipped up and down—up to turn the page, down to hold the book open. The reoccurring obstruction—of the overlapping center bends in the front—interferes with smooth operation of this design. Additionally this design has the top arches joined together which adds resistance when the clip is being slipped up and down as the legs are close to the center of the book at the top.

None of the book clip designs either by themselves or as part of a product category have become as well distributed or used by the general public as larger book holders which are sold in stationery stores, book stores and catalogues across the country. Thus there is a continued need for a more easily used small portable book holder.

Compared to design U.S. Pat. No. 4,932,680 above, the smooth book clip has fewer obstructions to use. These are described under the summary section below. My innovative invention is an improvement, and will be more easily managed and user friendly.

SUMMARY OF THE INVENTION

A book clip formed of bent wire or other flexible and elongated material that rebounds readily to its formed shape and resists breaking, having two parallel legs and a perpendicular crosspiece connected by squared arches at the top.

The book clip holds the pages of a book open for viewing. The book can then be stood up on its own, laid down, or propped against another object, thus leaving the hands free to write, eat or do other activities while a person has access to the open pages. It can also be used when holding a book with one hand, while taking pressure off of the digits of the hand that would otherwise be needed to hold the book opened. The book clip can be used without obstructing the view of the printed matter. It can be used in large and small books, paperback or hardbound, including cookbooks and technical manuals. The book clip is portable and can be easily inserted between pages of a closed book when not in use. It is smaller than most books and can be carried in a purse or pocket, either by itself or clipped inside the closed book as a bookmark.

Compared to design U.S. Pat. No. 4,932,680 above, the smooth book clip has fewer obstructions to use. It is made without overlapping the center bends, as the arches are separated from each other and do not cross at the center. This allows the clip to slip over the pages more smoothly—without the reoccurring obstruction of the backward protruding crossed wire. Also, the arches of the smooth book clip are about one-half inch apart at the top, making it easier to slip the back legs behind the pages, offering less friction and impediment than the prior design which has the tops of the arches joined. In addition, the legs have been made to extend further beyond the bottom of the front crosspiece so that the clip is less likely to come out when the pages are turned, thus avoiding having to reinsert the legs behind the pages so often. My innovative invention is therefore an improvement, and will be more easily managed and user friendly.

The smooth book clip has the advantages of previous models, and is smaller than most. It is easier to use than the latter sited design as it does not have the interferences sited above. Other advantages are included below under "Objects and Advantages".

OBJECTS AND ADVANTAGES

My book clip has the advantages of:

(a) holding a book open for reading or viewing;

(b) being capable of not obstructing vision of printed material in many books, depending upon the size of the top margin;

(c) being capable of being slipped up or down to remove obstruction of vision should it occur;

(d) allowing the book to stand on its own;

(e) being smaller than standard book holders and wide book clips, allowing it to be carried in a pocket;

(f) being smaller than standard book holders, allowing it to be inserted as a bookmark in the book while the book is not in use;

(g) capable of being carried clipped inside the book to hold a place and keep the book clip and book together for easier storage and transport;

(h) fitting all sizes of books, thick or thin, and with wide or narrow pages;

(i) fitting both paperback and hardbound books;

(j) being capable of production in different sizes;

(k) having the following attributes compared to prior patent U.S. Pat. No. 4,932,680:

(1) slipping in and out of the book without having the obstruction of the backward protruding overlapped wire in the front as in prior design;

(2) slipping more easily onto the book without the joining of the top arches as in prior design;

(3) slipping more easily in and out of the book because it is smoother after coating, as none of the pieces touch or overlap each other, so that extra coating will not adhere in these thicker areas which occur on prior design.

(4) being easier to slip up and down while reading as the arches are separated and the legs are further apart than prior design;

(5) being less likely to pull out of the book when the pages are being turned because the legs extend further beyond the front crosspiece than the prior design.

(l) having long-lasting construction of wire or other material that is not easily broken;

(m) being light weight;

(n) being easy to use;

(o) being used while standing or sitting as when riding mass transit;

(p) and of freeing the user from holding the book open by hand, thus reducing strain on the reader's hands, arms and shoulders, which is especially good for people suffering from carpal tunnel syndrome, repetitive stress disorders or arthritis.

(q) Further objects and advantages of my invention will become apparent from a consideration of the drawings and ensuing description.

DRAWING FIGURES (BLACK AND WHITE PHOTOS)

REFERENCE NUMERALS IN DRAWINGS

10 back leg(s)

12 arch(es) connecting back legs and front

14 bend(s) connecting arch(es) to front crosspiece

16 top crosspiece

18 U bend connecting top crosspiece to bottom crosspiece

20 bottom crosspiece

DESCRIPTION—FIGS. 1–2

Figure 1:
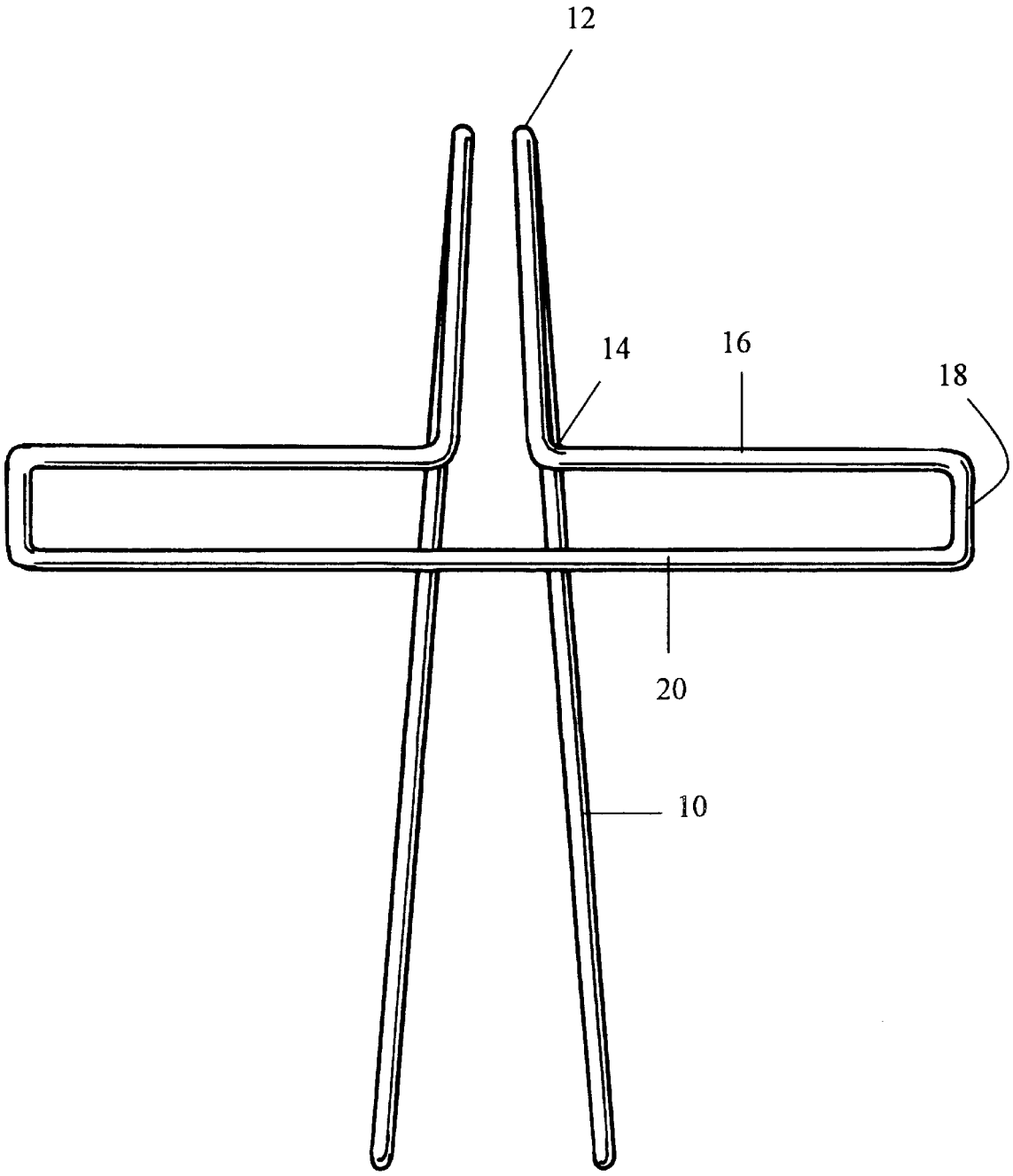
FIGS. 1 and 2 show the book clip from the front and side.
Figure 2:
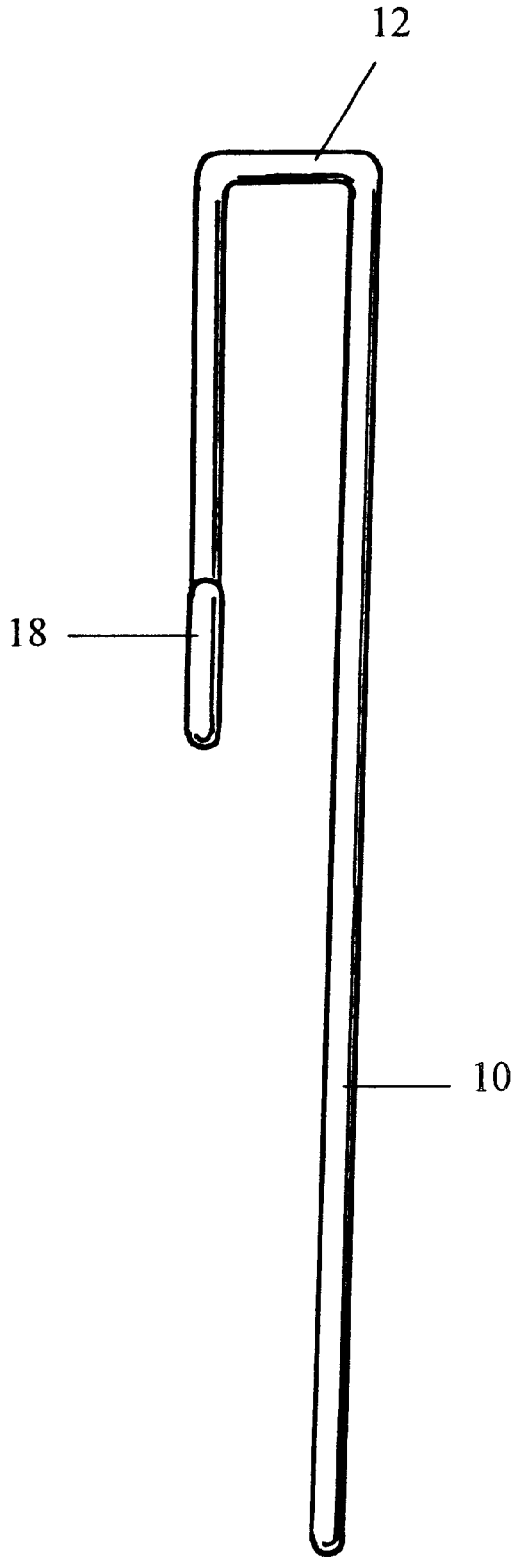

A typical embodiment of the clip, which is made from one piece of wire, is illustrated in FIGS. 1 (front top view) and 2 (side front view). The book clip has two rear 10 which bend slightly towards the front at the bottom. The rear legs connect by parallel arches at the top 12 to a perpendicular front crosspiece. At the base of the front of the arches, the wire bends 14 out at right angles on both sides. From right angle bends, a top crosspiece 16 connects by two U bends on either side 18 to a bottom crosspiece 20, which traverses the whole width of the crosspiece.

DESCRIPTION—FIG. 3

The clip is shown holding a paperbound book.

DESCRIPTION—FIG. 4

The clip is shown holding a hardbound book.

DESCRIPTION—FIG. 5

The clip is shown holding the place between pages of a technical paperbound book.

DESCRIPTION—FIG. 6

The clip is shown holding the place between pages of a closed book.

Figure 3:
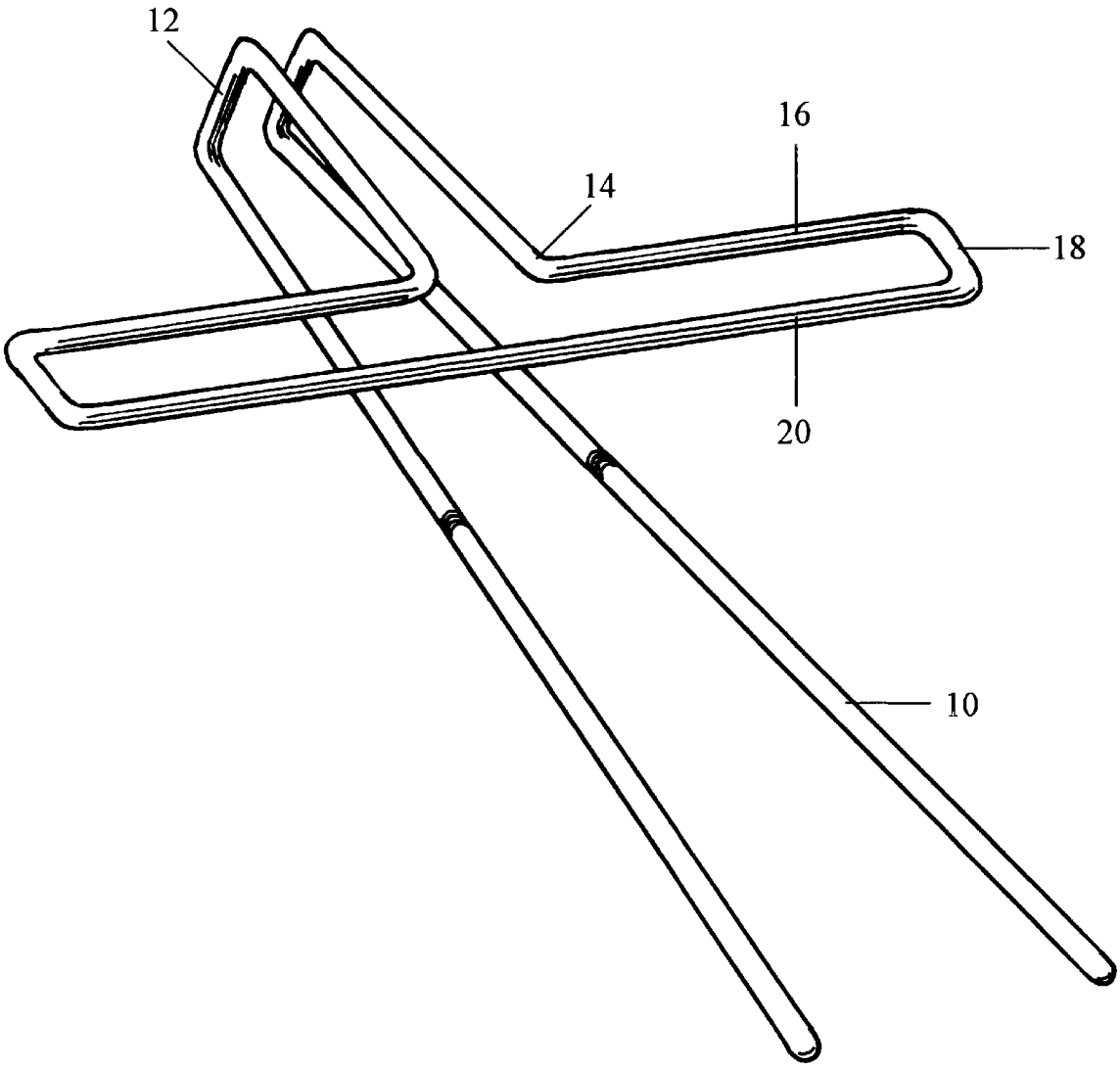
FIG. 3 shows the book clip holding a paperback book open and standing on its own.
Figure 4:
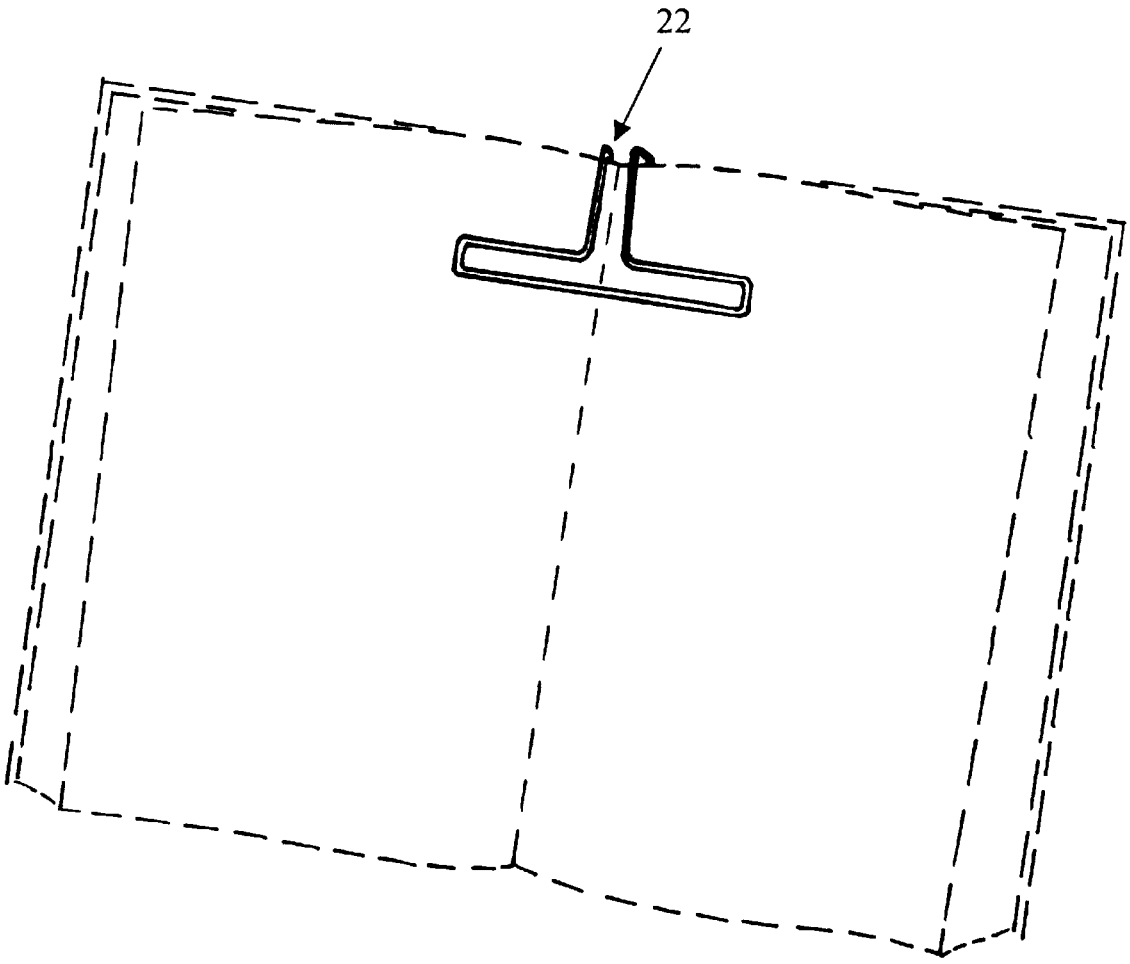
FIG. 4 shows the book clip holding a hardback book held and standing on its own.
Figure 5:
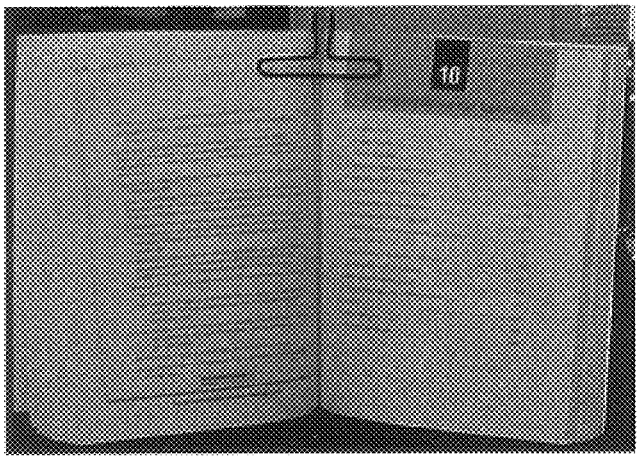
FIG. 5 shows a technical manual being held open and standing on its own.

Note About Description and Figures:

It is important to note that the model clips I made from coat hanger wire (FIGS. 1–5) are shaped very roughly and are not symmetrical. The dimensions in the pictures of the rough models are slightly different than planned and described under "measurements" below. Most notably FIGS. 3–5 show the arch pieces as taller and the legs shorter than specified in the preferred measurements. The actual product would be more uniform in proper manufacture, with more symmetrical "U" shaped bends on both sides, left and right. The arch at the top would be slightly squared to fit over the pages more neatly, and the two legs would be of equal length. The clip would be made of piano wire, wire similar to that used in manufacturing coat hangers, or other material that resists breaking. The material would be shaped before being coated in manufacture with powder coating or other smooth coating. The ends would be smoother than pictured, and covered with coating, unlike the ones I cut from a coat hanger and bent into shape. An alternative means of manufacture might not include coating, but would still result in a smooth finish and smooth ends on the legs. The ends of the legs could also be slightly pointed but still smooth.

Measurements

The device would measure about 3½" high from top of the "arches" to bottom of the legs.

It would measure about 3" wide (across crosspiece).

The outside depth at the top of the arches, front to back, would be about 7/16".

The outside depth between the front bottom of the crosspiece and back legs would be about 13/32", which is slightly less than at the top of the arches.

The outside distance between the front of the arches at the crosspiece bend, side to side, would be about ⅜".

The outside distance across the top of the arches (side to side) would be about ½".

The outside distance between the bottom of the two legs would be about ¾".

The outside vertical distance between the top and bottom of the front crosspiece would be about ⅜" high.

The outside distance between the top of the arch, to the crosspiece would be about 15/16".

The clip could be made smaller or larger, maintaining roughly proportional measurements in relationship to the various parts, though some proportions may vary slightly.

OPERATION

As shown in FIGS. 3 and 4, the book clip is slipped between the pages of a book with the two rear legs behind the open pages on the left and right hand sides of the book. One of the legs may be slipped behind the book cover, depending upon the thickness of the book and the place held. The back legs bend slightly forward to hold the pages in place.

Insertion of the clip into a book holds the book open with the bottoms of the pages fanning out slightly, thus allowing the book to stand upright. This leaves the hands free to write, study, eat a meal, or perform other activities while a person views the open pages. In this open position, the book can also be leaned against a prop or flat on a table to change the angle for reading.

The book may also be more easily held while standing or sitting without any place to set the book down, because it can be held with one hand while taking pressure off of the digits of the hand, which would otherwise be needed to hold the book open.

As the reader moves from page to page, the book clip is slipped up and down-up to turn the page, down to hold the book open. Much of the time, the clip is not removed from the book, as the legs stay behind the pages and only the crosspiece is raised above the top edge of the pages to be turned, and then slipped back over the turned pages. As the reader progresses, the legs would then be lifted out to adjust the number of pages between the left and right sides of the clip for proper pressure.

The clip holds about 30 pages on one side and as few as 5 (or the cover and one page) on the other side. In order to work smoothly and hold the pages open for easy reading, at least one side needs to hold about 25 pages (that is at least one of the legs is inserted behind about 25 pages). This allows for great flexibility (and approximation—no counting needed!) in inserting the legs and turning the pages, depending upon how tightly the reader likes the pages held open. The book clip is easy to use, requiring little if any instruction.

Generally the crosspiece would be at the top of the page in the margin, but for some larger books, it works better to have the crosspiece slip down a little more onto the book.

Figure 6:
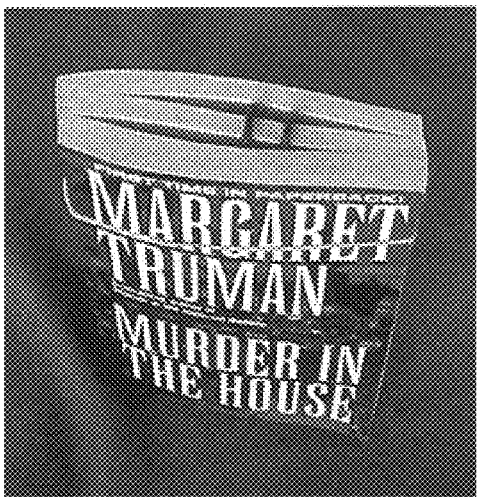
FIG. 6 shows the book clip serving as a bookmarker in a closed book.
Figure 1:
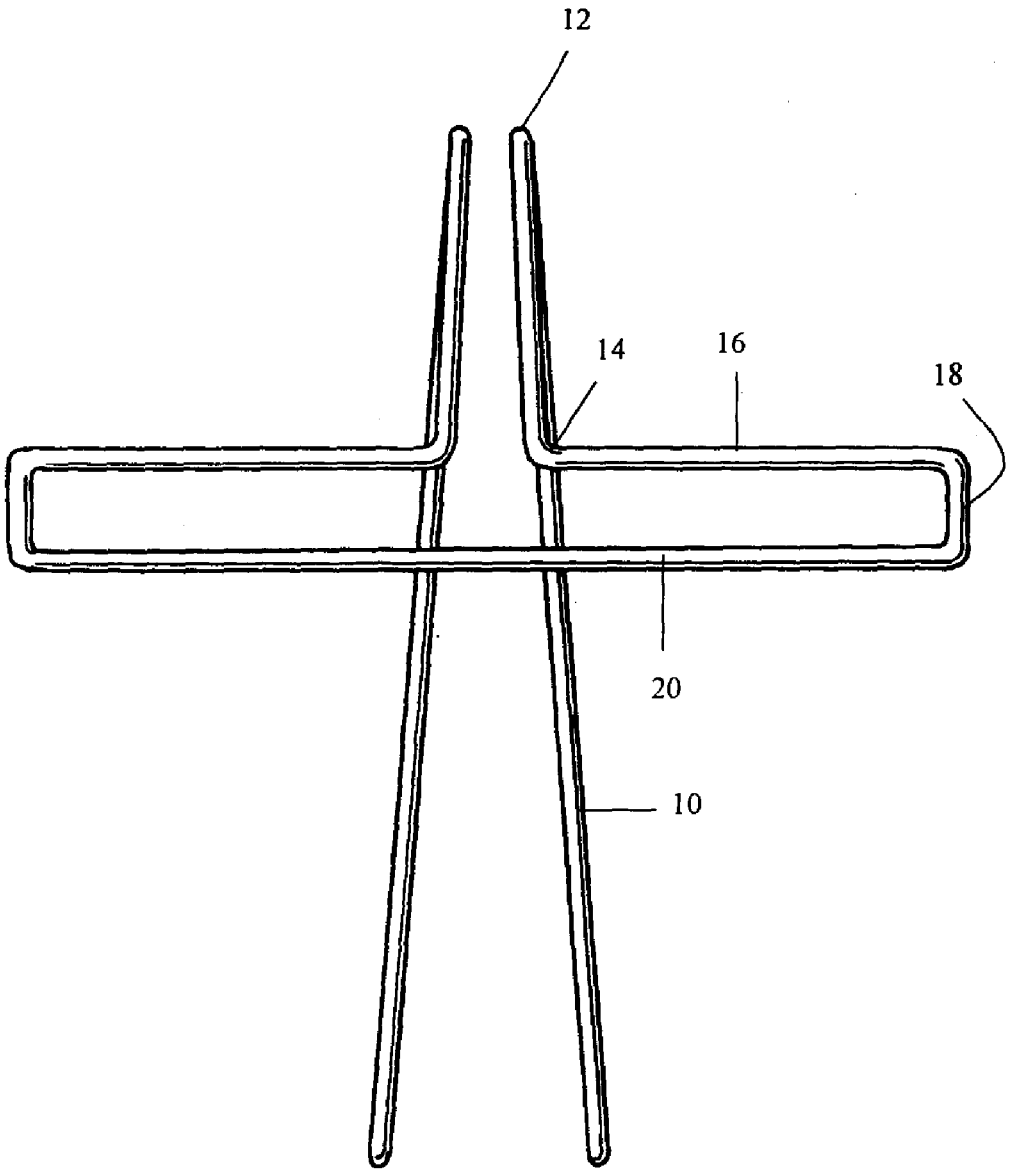
Figure 2:
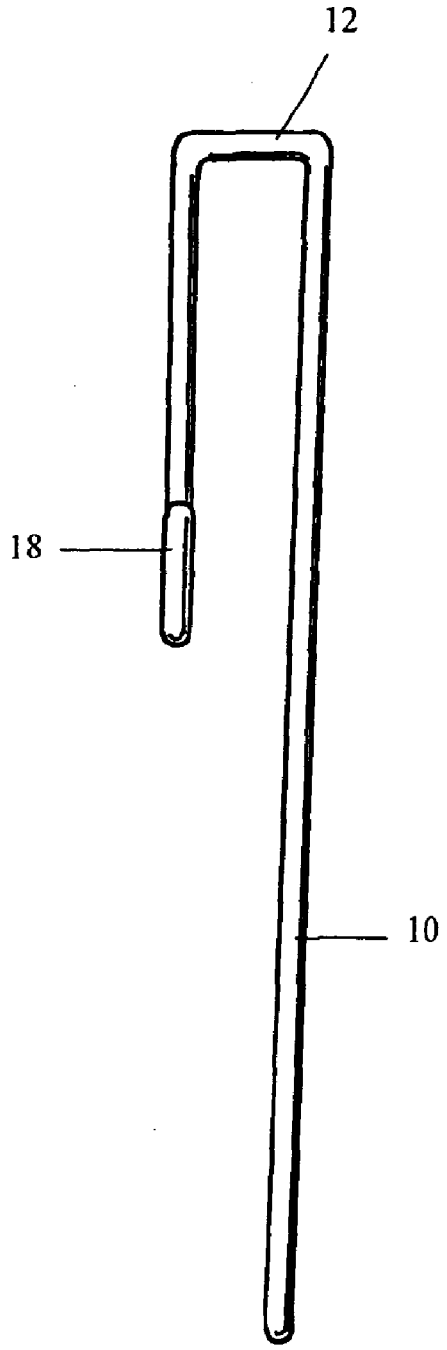
Figure 3:
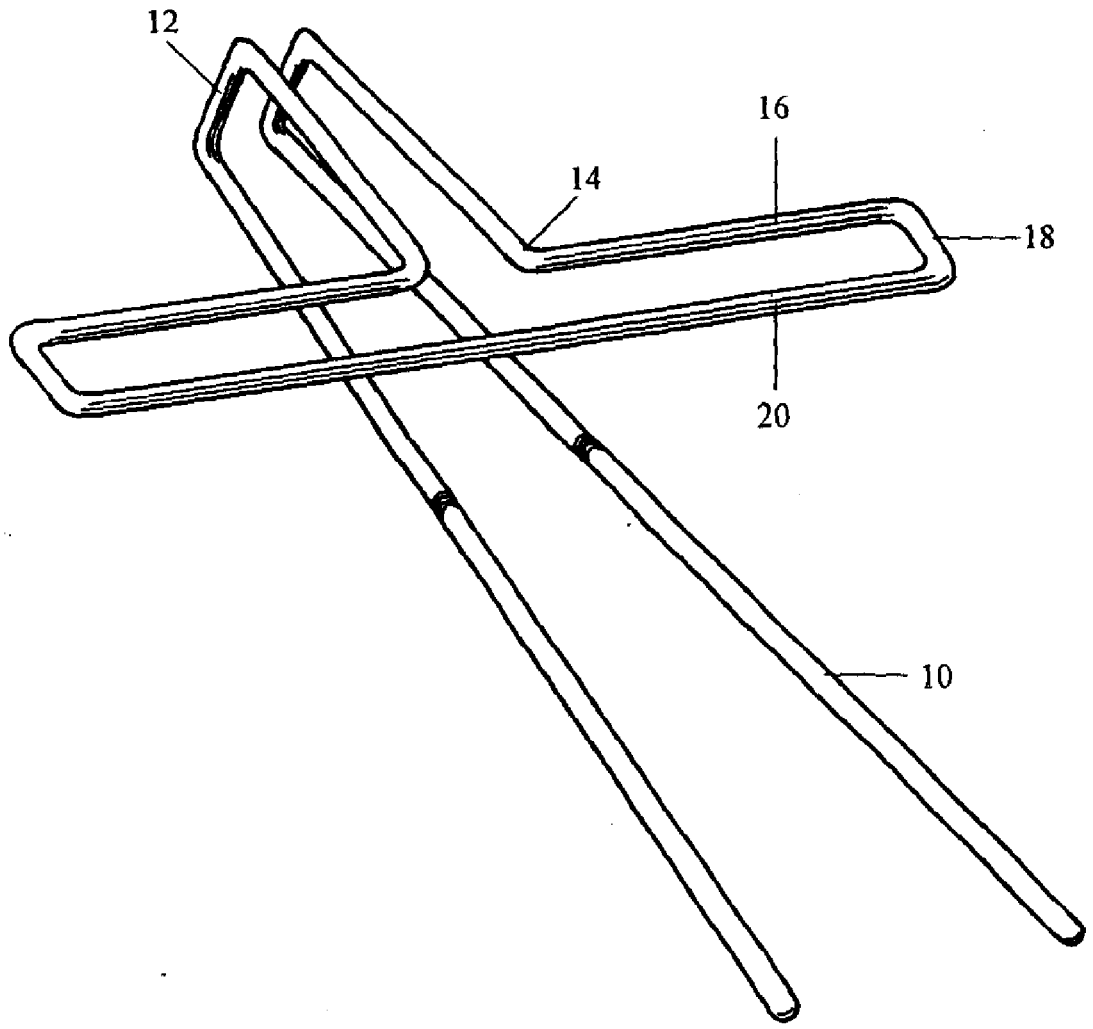
Figure 4:
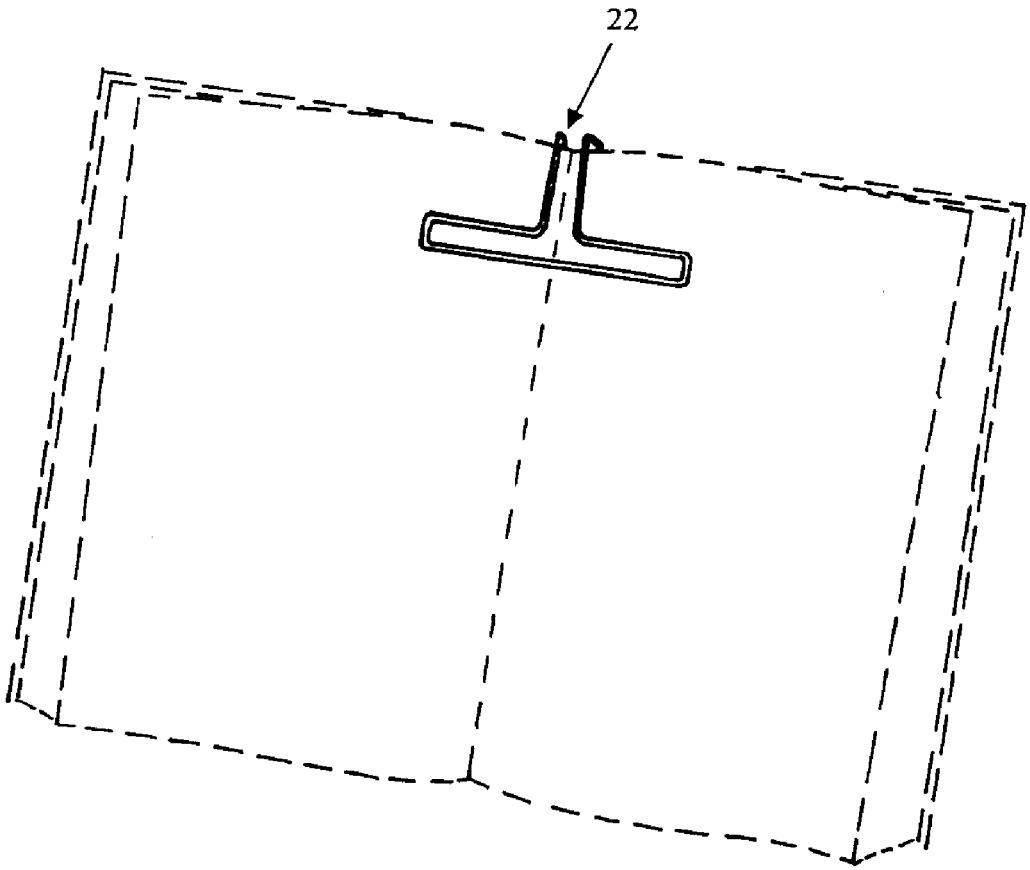

When the book is not in use or is being transported, the book clip can be inserted between the pages in the closed book—as a bookmark. This keeps the clip and book together for easy carrying as pictured in FIG. 6. As the manufactured book clip will be symmetrical and even, the space taken by the book clip in the closed book would be less than pictured, and the pages would lie more flat.

I claim:

1. A book clip formed of flexible elongated material that rebounds readily to its formed shape, comprising right and left elongated legs for slipping behind the pages of a book such that the right leg is slipped behind the pages on the right and the left leg is slipped behind the pages on the left;

a crosspiece which is positioned in front of said right and left legs, and which is approximately perpendicular to said right and left legs, the right and left legs being attached with said crosspiece by means of right and left approximately parallel separate arch pieces;

said right and left legs each having a top end and a bottom end, the bottom end having a tip;

said right and left legs being angled slightly towards said crosspiece for added pressure against the pages from the back;

said right and left legs being slightly further apart at the bottom ends than at the top ends for easy insertion between pages;

said right and left legs being rounded at the tip;

wherein said right and left approximately parallel separate arch pieces do not meet or cross over;

said right and left legs extending sufficiently beyond said front crosspiece to enable retention of said legs between pages of the book when the book clip is repositioned for the pages to be turned;

whereby the book clip moves more freely in and out of the book, without the thickness resulting from the crossover of the prior art at the center of the crosspiece, and whereby the book clip fits flat inside a closed book serving as a book mark without the thickness of the crossover, and whereby the book clip has increased flexibility, not being held rigid by the crosspiece in prior art, and whereby increased flexibility results in the book clip being inserted more easily, less clumsily, into a book.

2. The book clip as defined in claim 1 where the flexible elongated material is comprised of wire.

3. The book clip defined in claim 1 where the flexible elongated material is comprised of powder-coated wire.

4. The book clip defined in claim 1 where the flexible elongated material is comprised of plastic.

* * * * *

UNITED STATES PATENT AND TRADEMARK OFFICE

CERTIFICATE OF CORRECTION

PATENT NO. : 6,357,796 B1
DATED : March 19, 2002
INVENTOR(S) : Florence Halstead It is certified that error appears in the above-identified patent and that said Letters Patent is hereby corrected as shown below:

Delete title page and insert therefor the attached title page.

Delete drawing sheets 1 of 5 and insert therefor drawing sheets 1 of 4.

Signed and Sealed this

Twelfth Day of April, 2005

JON W. DUDAS
*Director of the United States Patent and Trademark Office*

(12) United States Patent
Halstead

(10) Patent No.: US 6,357,796 B1
(45) Date of Patent: Mar. 19, 2002

(54) SMOOTH BOOK CLIP

(76) Inventor: Florence Halstead, 1300 Lawrence St., El Cerrito, CA (US) 94530

( * ) Notice: Subject to any disclaimer, the term of this patent is extended or adjusted under 35 U.S.C. 154(b) by 0 days.

(21) Appl. No.: 09/641,210

(22) Filed: Aug. 18, 2000

Related U.S. Application Data

(60) Provisional application No. 60/150,418, filed on Aug. 24, 1999.

(51) Int. Cl.[7] ..... B42D 9/00

(52) U.S. Cl. ..... 281/42

(58) Field of Search ..... 281/42, 45, 28, 281/51, 15.1; 24/67.9, 546

(56) References Cited

U.S. PATENT DOCUMENTS

| | | | | | |
|---|---|---|---|---|---|
| 2,278,143 | A | * | 3/1942 | Matthews | 281/42 |
| 4,235,457 | A | * | 11/1980 | Brewer | 281/42 |
| 4,382,617 | A | * | 5/1983 | Fortier | 281/42 |
| 4,932,680 | A | * | 6/1990 | Rivera | 281/42 |
| D322,459 | S | * | 12/1991 | Pimienta | 281/42 X |

* cited by examiner

*Primary Examiner*—Willmon Fridie, Jr.

(57) ABSTRACT

A book clip formed of flexible elongated material such as wire that rebounds readily to its formed shape. The clip has two legs for slipping behind pages of a book on the right and left sides of the book. The legs are slightly further apart at the bottom for easy insertion between pages. A front cross-piece holds the pages of the book across the of the open pages so that the pages are pressed between the crosspiece and the right and left legs. The legs and crosspiece are joined by approximately parallel left and right arch pieces. The legs extend beyond the lower part of the crosspiece sufficiently so that they easily remain between the pages of the book when the book clip is slipped up for the pages to be turned. The book can then be stood up on its own, laid down, or propped against another object, thus leaving the hands free to write, eat or do other activities while a person has access to the open pages. The book clip is portable and can be easily inserted between pages of a closed book for marking the place when not in use. It takes very little space when being carried in a purse or pocket, either by itself or when marking the pages of a closed book.

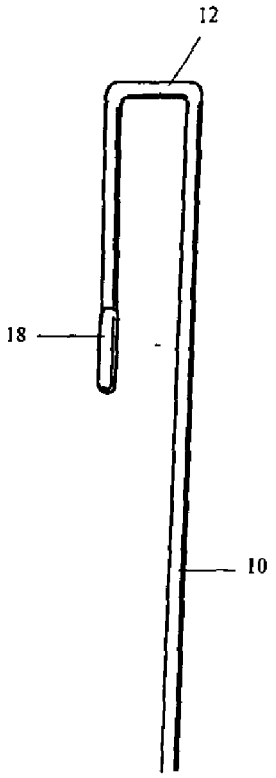

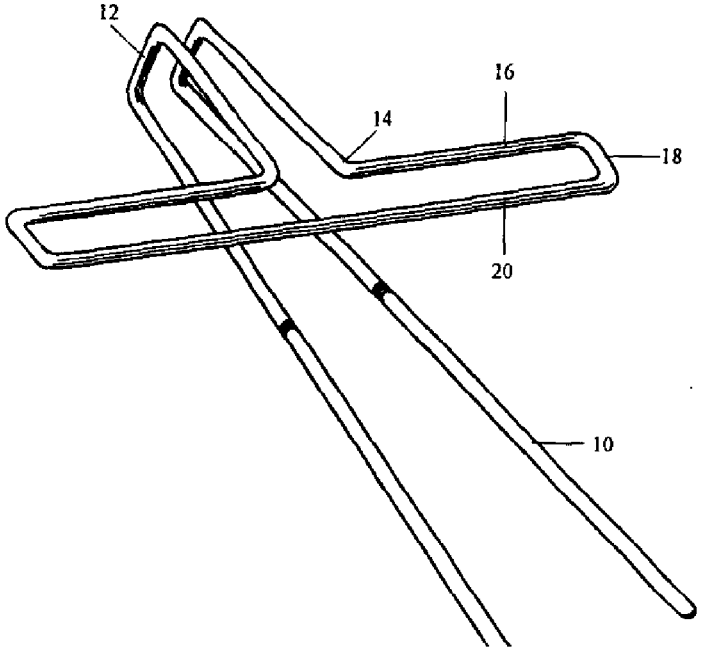

4 Claims, 4 Drawing Sheets